US006591527B2

(12) United States Patent
Park

(10) Patent No.: US 6,591,527 B2
(45) Date of Patent: Jul. 15, 2003

(54) INDOOR/OUTDOOR ADVERTISING DEVICE AND METHOD FOR MANUFACTURING THE SAME

(76) Inventor: Young Ku Park, No. 794, Dapsimri-4Dong, dongdaemoon-ku, Seoul 130-034 (KR)

( * ) Notice: Subject to any disclaimer, the term of this patent is extended or adjusted under 35 U.S.C. 154(b) by 0 days.

(21) Appl. No.: 09/877,662

(22) Filed: Jun. 11, 2001

(65) Prior Publication Data

US 2002/0023377 A1 Feb. 28, 2002

(30) Foreign Application Priority Data

Aug. 28, 2000 (KR) ..... 2000-49978

(51) Int. Cl.[7] ..... G09F 13/04
(52) U.S. Cl. ..... 40/564; 40/550; 29/854
(58) Field of Search ..... 40/550, 551, 552, 40/564; 29/854, 825, 857, 858

(56) References Cited

U.S. PATENT DOCUMENTS 4,079,168 A * 3/1978 Schwemmer et al. ..... 428/416
5,043,716 A * 8/1991 Latz et al. ..... 345/82
5,621,991 A * 4/1997 Gustafson ..... 40/544
5,819,454 A * 10/1998 Rosenitsch ..... 40/452
5,918,454 A * 7/1999 Tanaka et al. ..... 57/124

FOREIGN PATENT DOCUMENTS

JP 0680928 A * 6/1994
WO WO 9516983 A1 * 6/1995
WO WO-9516983 A1 * 6/1995

* cited by examiner

*Primary Examiner*—S. Joseph Morano
*Assistant Examiner*—Frantz F. Jules
(74) *Attorney, Agent, or Firm*—Harrison & Egbert

(57) ABSTRACT

An indoor/outdoor advertising device and a method for manufacturing the same. The indoor/outdoor advertising device, which is used for indoor/outdoor advertisement materials or signboards, can be easily manufactured due to its simple structure and can provide an outstanding advertisement effect not only at night but also during the daytime by emitting light from the light elements throughout surfaces thereof with less consumption of electric power. The method for manufacturing the indoor/outdoor advertising device according to the invention includes the steps of manufacturing a panel, coating a luster urethane paint on a lower portion, first coating a transparent epoxy and acrylic material, fixedly lining a plurality of light elements irrelevant to size or shape, lining out one end tip of + and – lead wires connected to the plurality of light elements from the mold, secondly coating the transparent epoxy, thirdly coating the epoxy on an upper surface of the transparent epoxy, and supplying a power to the lead wires for emission of light.

4 Claims, 6 Drawing Sheets

INDOOR/OUTDOOR ADVERTISING DEVICE AND METHOD FOR MANUFACTURING THE SAME

BACKGROUND OF THE INVENTION

1. Field of the Invention

The present invention relates to an indoor/outdoor advertising device and a method for manufacturing the same, and in particular, to an indoor/outdoor advertising device used for indoor/outdoor advertisement materials or signboards (e.g., indoor decorations, outdoor signboards, clocks, guiding boards, scoreboards, displays on show windows, etc.) that can be easily manufactured because of its simple structure and that can provide an outstanding advertisement effect not only at night but also during the daytime by emitting light from the light elements throughout surfaces thereof with less consumption of electric power.

2. Description of the Related Art

In general, neon lamps are mainly used for advertising materials or neon signs. However, neon lamps are apt to be damaged due to exposure of neon tubes therefrom. Furthermore, neon lamps consume a considerable amount of electric power due to the use of high electric voltage.

Moreover, neon lamps have a low durability and can hardly be used under water.

A light emitting structure using a light emitting diode (LED) has been suggested in recent days as means to supplement the above drawbacks of neon lamps.

The conventional light emitting structure is manufactured by installing LEDs on a transparent floor and pouring polymer resin thereonto. However, this manufacturing method poses problems in controlling thickness of the light emitting structure to be slim as well as in providing a light emitting surface of various colors due to a comprehensively dark tone of the advertisement materials employing the LED, which is the only source of brightness.

Japanese Laid-Open Patent No. Hei 11-195564, filed on Jul. 9, 1999 and laid open on Nov. 2, 2000, discloses an LED for display.

In the LED for display disclosed in Japanese Laid-Open Patent No. HeiII-195564 as shown in FIGS. 7 and 8 thereof, a light emitted from an LED 20 travels straight after penetrating a through hole 31 formed in the reflecting material 30 and is reflected through both side walls thereof, or the LED 20 only is installed inside of a mold frame II without any reflecting material for emitting a light.

This conventional technology employed an additional reflecting material 30 of a funnel shape to emit the light from the LED 20 as shown in FIGS. 7 and 8 because the light from the LED 20 is not properly dispersed or emitted in case of FIGS. 9 and 10. However, the reflecting material 30 can hardly be manufactured into a funnel shape and combined with the LED 20, thereby posing difficulties in the manufacturing process and increasing the manufacturing cost.

BRIEF SUMMARY OF THE INVENTION

It is, therefore, an object of the present invention to provide an indoor/outdoor advertising device and a method for manufacturing the same that can achieve a dispersion effect without using any additional funnel and with or without an epoxy molding on light elements by emitting the light throughout the entire emitting surface of an advertisement material at night or even during the daytime, and that consumes a smaller amount of electric power by employing LEDs and that can be safely used under water because of an epoxy molding.

To achieve the above object, there is provided a method for manufacturing an indoor/outdoor advertising device, comprising: a first step of manufacturing a mold (panel) for characters or shapes of a signboard or an advertising material; a second step of coating a luster urethane paint on a lower portion or on both side walls of the panel at a predetermined thickness; a third step of first coating a transparent epoxy and acrylic material at a thickness ranged 0.5–5 mm on an upper surface of the luster urethane paint; a fourth step of fixedly lining a plurality of light elements irrelevant to size or shape at intervals ranged 1–5 cm in accordance with the mold for characters or shapes so as to stream electricity; a fifth step of lining out one end tip of + and – lead wires connected to the plurality of light elements from the mold; a sixth step of secondly coating the transparent epoxy to the extent of covering the plurality of light elements; and a seventh step of thirdly coating the epoxy, which is a mixture of a translucent fluorescent pigment with a light dispersing agent, on an upper surface of the transparent epoxy.

According to one aspect of the present invention, the method for manufacturing the indoor/outdoor advertising device is characterized by aligning polycarbonate in a mold shape instead of the epoxy, which is a mixture of a translucent fluorescent pigment and with a light disperse agent, on an upper surface of the transparent epoxy.

According to another aspect of the present invention, the method for manufacturing the indoor/outdoor advertising device is characterized by covering the mold of a transparent acrylic material with a space as thick as the second transparent epoxy material that would have been coated, and by coating the epoxy mixed with a translucent fluorescent pigment.

According to still another aspect of the present invention, the method for manufacturing an indoor/outdoor advertising device is characterized by covering the mold of a transparent acrylic material with a space as thick as the transparent epoxy that would have been coated, and by aligning the polycarbonate thereon in a mold shape.

According to still another aspect of the present invention, the method for manufacturing an indoor/outdoor advertising device is characterized by employing LEDs as light elements and uniformly aligning the LEDs upward, downward or in a transversal direction so that the head portions of the LEDs can be adjacent to a bottom surface or side surfaces thereof.

An indoor/outdoor advertising device employing light elements as a light source according to the present invention comprises: a mold of a predetermined shape; a first epoxy and acrylic material first coated on an inner surface of the mold for reflecting lights from the light elements; a second transparent epoxy material coated for dispersing the lights from the light elements installed at an upper portion of the first epoxy and acrylic material; and a third epoxy material, which is a mixture of a translucent fluorescent pigment with a light dispersing agent, aligned on an upper surface of the second transparent epoxy material for smoothing emission of lights.

BRIEF DESCRIPTION OF THE SEVERAL VIEWS OF THE DRAWINGS

The above and other objects, features and advantages of the present invention will become more apparent from the following detailed description when taken in conjunction with the accompanying drawings.

DETAILED DESCRIPTION OF THE INVENTION

Preferred embodiments of the present invention will be described herein below with reference to the accompanying drawings. In the following description, well-known functions or constructions are not described in detail since they would obscure the 10 invention in unnecessary detail.

Figure 6:
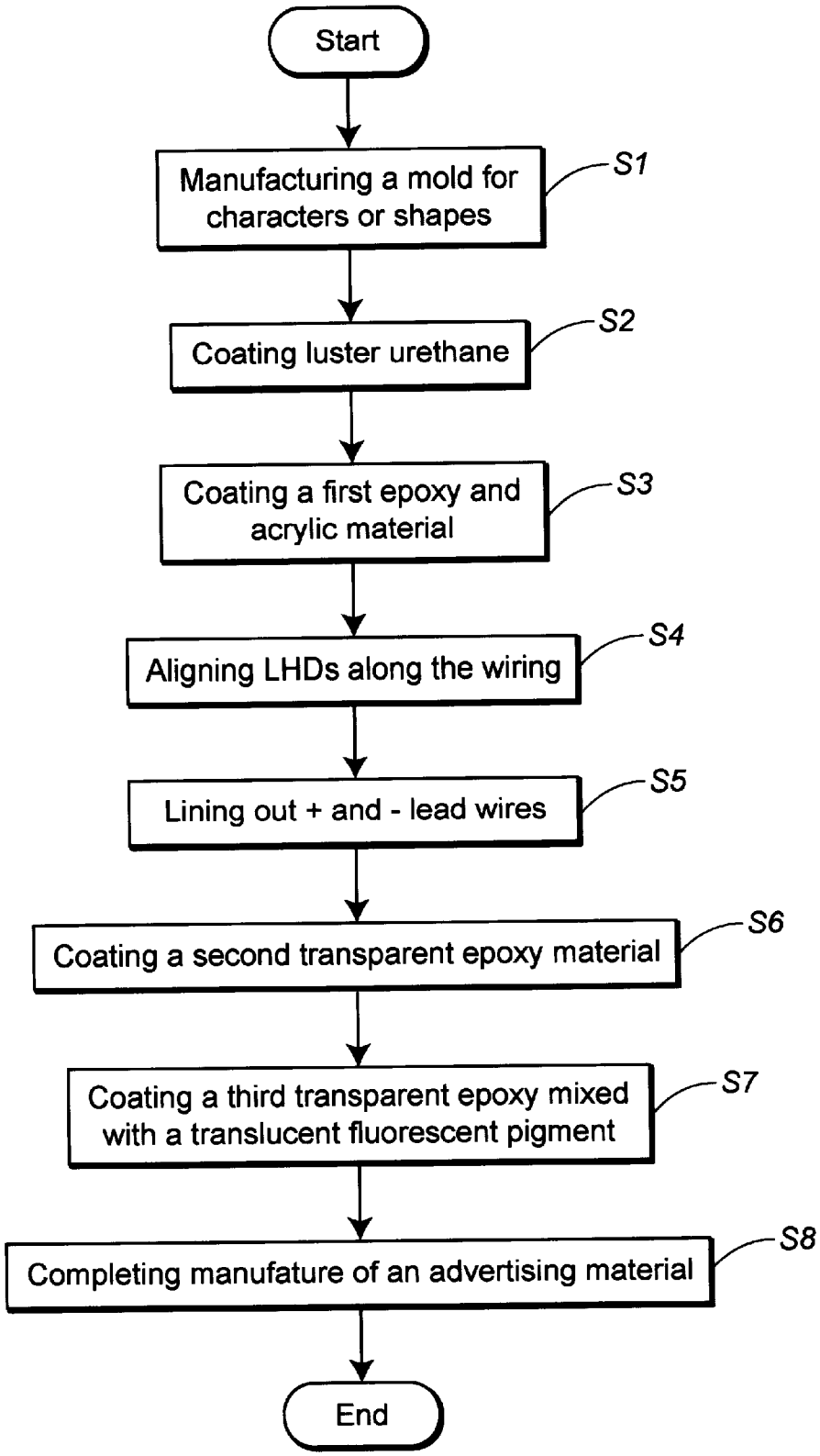
FIG. 6 is a flow chart illustrating the method for manufacturing an indoor/outdoor advertising device according to the first embodiment of the present invention.
Figure 7:
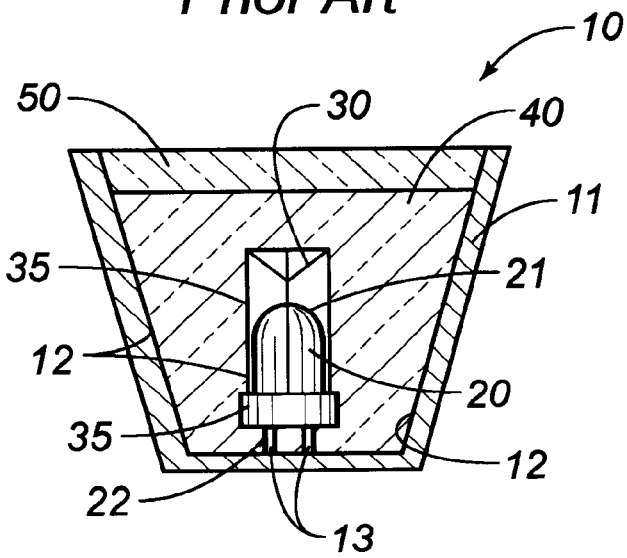
FIG. 7 Prior Art
FIGS. 7 and 8 are cross-sectional views of a conventional LED for display.
Figure 8:
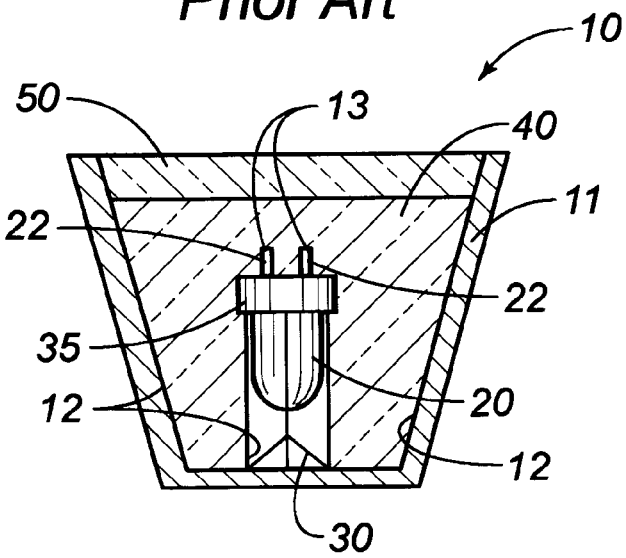
FIG. 8 Prior Art
Figure 9:
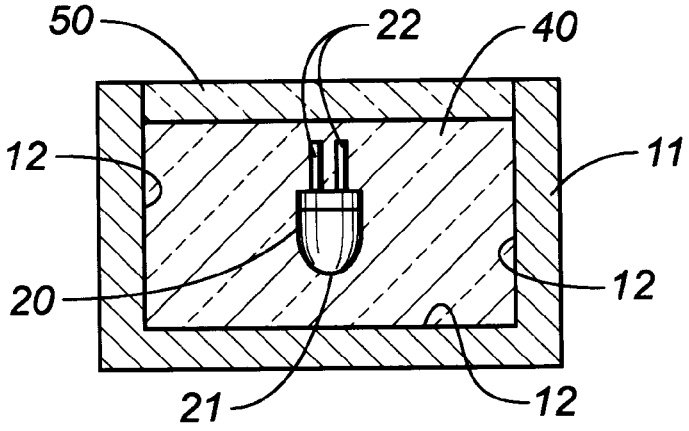
FIG. 9 Prior Art
FIGS. 9 and 10 are diagrams exemplifying another conventional LED for display.
Figure 10:
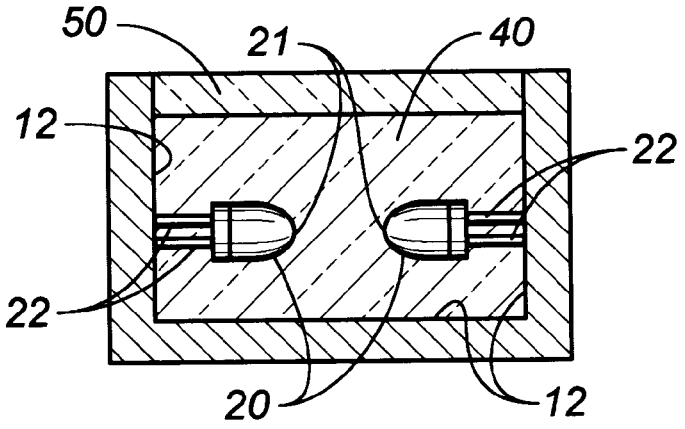
FIG. 10 Prior Art

FIG. 6 is a flow chart illustrating the method for manufacturing an indoor/outdoor advertising device according to the first embodiment of the present invention.

Referring to FIG. 6, a panel is produced by manufacturing a mold for characters or shapes of a signboard or an advertising material (S1).

A luster urethane paint 2 is coated on a lower portion and on both side walls of the panel 1 at a predetermined thickness (S2).

A first transparent epoxy and acrylic material 3 is coated on an upper surface of the luster urethane paint 2 at a thickness ranged 1–5 mm so as to generate a light reflecting layer (S3).

Light elements of different sizes or shapes (e.g., LEDs) are soldered and aligned along the wiring 5 in accordance with the mold 1 for characters and shapes on the c first transparent epoxy and acrylic material 3 at intervals of 1–5 cm upward, downward a transversal direction (S4).

Here, the light elements are not bound by size or shape, and may be of any shape such as a cylindrical shape, a rectangular chip shape or a triangular shape.

Figure 1:
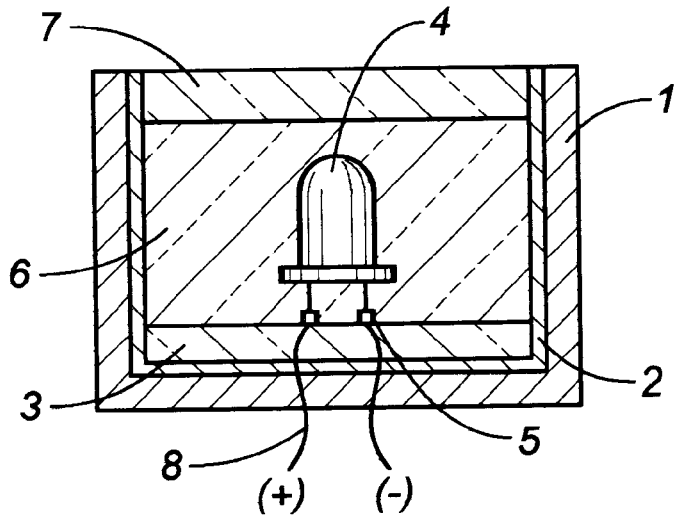
FIG. 1 is a diagram illustrating a method for manufacturing an indoor/outdoor advertising device according to a first embodiment of the present invention.
Figure 2:
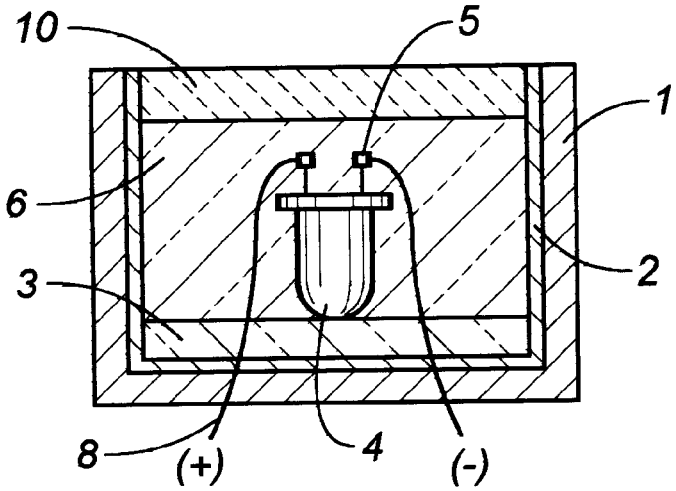
FIG. 2 is a diagram illustrating a method for manufacturing an indoor/outdoor advertising device according to a second embodiment of the present invention.

When the wiring 5 has been aligned downward as shown in FIG. 1, the light elements 4 can be uniformly aligned upward. When the wiring 5 has been aligned upward as shown in FIG. 2, the light elements 4 can be uniformly aligned downward. In that case, the light elements 4 should be installed to be in contact with the first transparent epoxy and acrylic material 3.

The reason for installing the light elements 4 to be in contact with the first transparent epoxy and acrylic material 3 is to secure a sufficient light emitting space by scattering the lights reflected from the light elements so as to eliminate the dark part on a comprehensive basis and to smooth emission of the lights.

Figure 3:
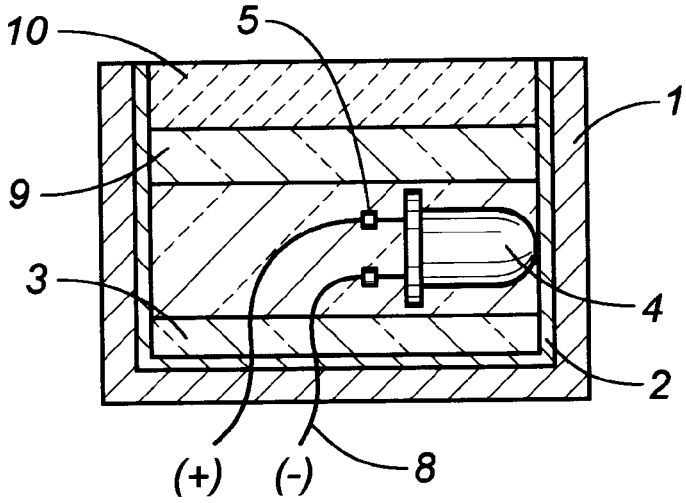
FIG. 3 is a diagram illustrating a method for manufacturing an indoor/outdoor advertising device according to a third embodiment of the present invention.
Figure 4:
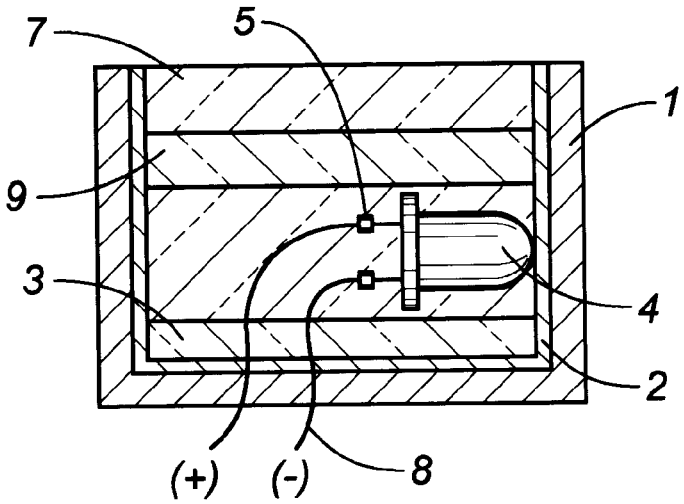
FIG. 4 is a diagram illustrating a method for manufacturing an indoor/outdoor advertising device according to a fourth embodiment of the present invention.

In case of another embodiment to be described later (as shown in FIGS. 3 and 4), the wiring 5 may be aligned on side surfaces of the mold I for characters and shapes and the light elements 4 may be connected to the wiring 5.

Meanwhile, power is supplied from a lead wire 8, which is formed by penetrating a hole through the mold 1 and lining out the + and – lead wires of the wiring 5, on which the light elements 4 are aligned (S5), from the mold 1.

A light scattering layer is formed by coating the second transparent epoxy material 6 to the extent of covering the plurality of light elements 4 (S6).

A third epoxy material 7, which is a mixture of a translucent fluorescent pigment with a light dispersing agent, is coated on an upper surface of the second transparent epoxy material 6. Here, the light dispersing layer is formed on the third epoxy because the translucent fluorescent pigment is mixed therewith (S7).

Figure 5:
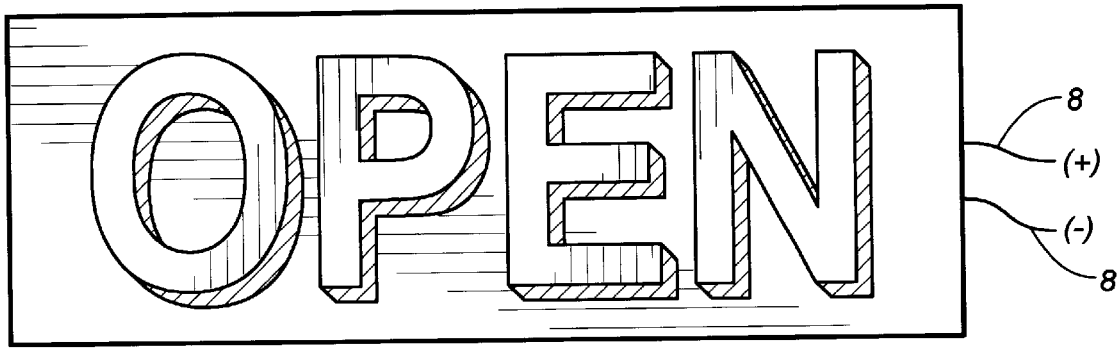
FIG. 5 is a plan view of an indoor/outdoor advertising device according 25 embodiment of the present invention.

The third epoxy material 7, which is a mixture of the translucent pigment with the light emitting material, may also formed by mixing a white translucent fluorescent pigment with a color pigment so as to save an amount of the color pigment. An advertising material is completely manufactured as shown in FIG. 5 by adding a diffusion agent to the third epoxy material 7 to diffuse the light from the light dispersing layer (S7, S8).

FIG. 2 is a diagram illustrating a method for manufacturing an indoor/outdoor advertising device according to a second embodiment of the present invention. Instead of the third epoxy material 7, which is a mixture of the translucent fluorescent pigment with the light dispersing agent, polycarbonate (PC) 10 is formed in a mold shape and aligned on an upper surface of the second transparent epoxy material 6.

FIG. 3 is a diagram illustrating a method for manufacturing an indoor/outdoor advertising device according to a third embodiment of the present invention. A transparent acrylic material 9 is aligned with a space as thick as the second transparent epoxy material 6 that would have been coated, and polycarbonate 10 is aligned in a mold shape thereon.

FIG. 4 is a diagram illustrating a method for manufacturing an indoor/outdoor advertising device according to a forth embodiment of the present invention. In the fourth embodiment, the transparent acrylic material 9 is aligned on upper surfaces of the light elements 4 with a space as thick as the second transparent epoxy material 6 that would have been coated, and the third epoxy material 7, which is a mixture of the translucent fluorescent pigment with the light dispersing agent, is coated thereon.

The third and the fourth embodiments shown in FIGS. 3 and 4 are mainly applied to a signboard of a large scale. No coating of the second transparent epoxy material 6 serves to reduce time for hardening the epoxy as well as to reduce the weight of the advertising material, thereby easing the working process and saving the cost.

If a power connected along the lead wire 8 is switched on upon completion of the advertising material as described above, the power is supplied to the wiring 5 along the lead wire 8, and subsequently to the plurality of light elements 4 connected to the wiring 5 so as to enlighten the light elements 4.

If the light elements 4 are enlightened, the light generated from the light elements 4 is scattered from the first transparent epoxy and acrylic material 3, and dispersed through the second transparent epoxy material 6 coated on an upper surface of the first transparent epoxy and acrylic material 3.

The light dispersed through the second transparent epoxy material 6 emits light through the third epoxy material 7, which is a mixture of the translucent fluorescent pigment with the light dispersing agent.

The light dispersed through the second transparent epoxy material 6 is emitted the polycarbonate 10 in case of the second embodiment, while the lights from the light elements 4 is emitted through the transparent acrylic material 9 and the polycarbonate 10. On the other hand, the lights from the light elements 4 is emitted throughout the surface of the transparent acrylic material 9 and the third epoxy material 7.

Thus, the present invention can achieve an advertising effect by using a particular material. Using the light elements 4 can serve to reduce consumption of the electric power, thereby providing a great economic benefit.

The conventional advertising device is generally manufactured to have a display window composed of light emitting dots by applying the light elements. However, the advertising device according to the present invention is manufactured to have a structure of dispersing lights from the light elements that is characterized by smoothly dispersing the lights onto characters, numbers or pictures throughout a surface of the display window of a variety of displaying materials. According to the present invention, steel plates, stainless steel plates, stone materials, acrylic materials, brass wire, wood or panels made of diverse synthetic materials can be used for the mold 1 to display characters, numbers or pictures.

As described above, the present invention can achieve a superior advertising effect in comparison with the conventional neon lamps, etc. by coating a plurality of epoxy layers on desired characters or shapes and by aligning the light elements so as to stream electricity therealong as well as by emitting lights through the light elements when supplying the power. The present invention provides additional advantages of expressing a variety of character styles, colors or images as well as of achieving outstanding advertising effects not only at nights but also during the daytime.

Further, the advertising device manufactured according to the present invention is rarely damaged or out of order, and can be used on a semi-permanent basis. In addition, employing the LEDs for light elements serves to reduce the maintenance cost due to their less consumption of an electric power as well as to carry the same advertising effect under water as in the air.

While the invention has been shown and described with reference to certain preferred embodiments thereof, it will be understood by those skilled in the art that various changes in form and details may be made therein without departing from the spirit and scope of the invention as defined by the appended claims.

I claim:

1. A method of manufacturing an indoor/outdoor advertising device comprising:

manufacturing a panel for characters or shapes of a desired signboard;

coating a luster urethane paint on a lower portion or on side walls of said panel at a predetermined thickness;

coating a transparent epoxy and acrylic material on an upper surface of the coated luster urethane paint, the coated transparent epoxy and acrylic material having a thickness of between 0.5 millimeters and 5 millimeters;

fixedly lining a plurality of light elements at intervals ranging between 1 centimeter and 5 centimeters on said panel, said plurality of light elements having a positive lead wire and a negative lead wire extending therefrom;

extending a tip of each of said positive lead wire and said negative lead wire outwardly of said panel;

coating transparent epoxy over said plurality of light elements so as to cover said plurality of light elements; and aligning a polycarbonate material onto an upper surface of the coated transparent epoxy over said plurality of light elements.

2. The method of claim 1, further comprising:

aligning said plurality of light elements in a direction such that a head portion thereof is in contact with the coated transparent epoxy and acrylic material.

3. A method of manufacturing an indoor/outdoor advertising device comprising:

manufacturing a panel for characters or shapes of a desired signboard;

coating a luster urethane paint on a lower portion or on side walls of said panel at a predetermined thickness;

coating a transparent epoxy and acrylic material on an upper surface of the coated luster urethane paint, the coated transparent epoxy and acrylic material having a thickness of between 0.5 millimeters and 5 millimeters;

fixedly lining a plurality of light elements at intervals ranging between 1 centimeter and 5 centimeters on said panel, said plurality of light elements having a positive lead wire and a negative lead wire extending therefrom;

extending a tip of each of said positive lead wire and said negative lead wire outwardly of said panel;

forming a space of a predetermined thickness from an upper surface of the coated transparent epoxy and acrylic material;

covering said space of the predetermined thickness with a transparent acrylic material; and coating said transparent acrylic material with a polycarbonate material.

4. The method of claim 3, further comprising:

aligning said plurality of light elements in a direction such that a head portion thereof is in contact with the coated transparent epoxy and acrylic material.

* * * * *